US005799518A

United States Patent [19]

Du

[11] Patent Number: 5,799,518

[45] Date of Patent: Sep. 1, 1998

[54] DOOR LOCK ASSEMBLY

[75] Inventor: Ku Ni Du, Taipei, Taiwan

[73] Assignee: Suetech Industries Co., Ltd., Taipei, Taiwan

[21] Appl. No.: 785,951

[22] Filed: Jan. 22, 1997

[51] Int. Cl.[6] ..... E05B 47/00

[52] U.S. Cl. ..... 70/281; 70/277; 335/282

[58] Field of Search ..... 70/277–283; 335/255, 335/260, 262, 278, 282

[56] References Cited

U.S. PATENT DOCUMENTS

| | | | |
|---|---|---|---|
| 3,901,542 | 8/1975 | Salzman et al. | 292/144 |
| 4,021,065 | 5/1977 | Geringer | 292/144 |
| 4,656,850 | 4/1987 | Tabata | 70/276 |

*Primary Examiner*—M. C. Gellner
*Assistant Examiner*—Raymond Barrera
*Attorney, Agent, or Firm*—Banner & Witcoff, Ltd.

[57] ABSTRACT

A door lock assembly includes a lock body, a latching unit, an electromagnetic driving device, and a linkage mechanism. The latching unit has a locking pin which is mounted slidably in the lock body. The electromagnetic driving device has an inner tube and an outer tube which is connected to the lock body, and first and second insulating ring members connected respectively to two ends of the inner tube and received in the outer tube. An electric coil is mounted around the inner tube. The first ring member has two annular projections and an annular groove formed between the annular projections. The end wires of the electric coil are extendible respectively into the annular groove through the axial hole and the axial notch of the second annular projection in order to connect an end of the electric wire. The linkage mechanism has a first end portion which is received in the inner tube and a second end portion which abuts against a lower end of the locking pin of the latching unit.

5 Claims, 7 Drawing Sheets

DOOR LOCK ASSEMBLY

BACKGROUND OF THE INVENTION

1. Field of the Invention

This invention relates to a door lock assembly, more particularly to a door look assembly which has a latching unit that is actuated by an electromagnetic driving device.

2. Description of the Related Art

The improvement of the present invention is directed to a conventional door lock assembly 10 as shown in FIG. 1. The conventional door lock assembly 10 comprises a lock body 11, a linkage mechanism 12 and an electromagnetic driving device 13. A latching unit is mounted slidably in a receiving hole 112 of the lock body 11 and has a locking pin 124 and a spring member 125 associated operably with the locking pin 124 in order to urge the locking pin 124 to an unlocked position. The linkage mechanism 12 has a push rod 121, a steel ball 122 and an L-shaped lever 123. The L-shaped lever 123 is connected pivotably in a transverse notch 111 of the lock body 11 at a distal end 1233 of a first arm 1231 of the L-shaped lever 123 by means of a pivot pin 1234. The L-shaped lever 123 has a second arm 1232 which abuts against a lower end of the locking pin 124. The steel ball 122 is disposed between an end of the push rod 121 and the first arm 1231 of the L-shaped lever 123, and is confined rotatably within the transverse notch 111 of the lock body 11.

Referring to FIGS. 1 and 2, the electromagnetic driving device 13 has an I-shaped insulating inner tube 131 with two annular projections 1313, 1314 formed at two ends thereof, an electric coil 132 wrapped around an intermediate tube body 1311 of the inner tube 131, and an insulating outer tube 134 sleeved concentrically around the inner tube 131. The outer tube 134 engages threadedly the transverse notch 111 of the lock body 11 at one end thereof and has an iron disc member 133 fitted into the other end thereof. The diameters of the annular projections 1313, 1314 and the disc member 133 is equal to the inside diameter of the outer tube 134. The push rod 121 extends slidably through the inner tube 131. An electric wire 14 is connected to a power supply (not shown) at one end thereof and extends into the other end of the outer tube 134 through a peripheral notch 1331 of the disc member 133 and a peripheral notch 1312 of one of the annular projections 1313 in order to connect electrically two end wires 1322 of the electric coil 132. Therefore, when the electric coil 132 is energized by the power supply via the electric wire 14, a magnetic field is produced within the inner tube 131, thereby moving the push rod 121 to push the steel ball 122 and the L-shaped lever 123 in order to push the locking pin 124 upward into a locked position against the biasing force of the spring member 125, as best illustrated in FIG. 3.

The conventional door lock assembly 10 further has a control device 15 for actuating the electromagnetic driving device 13 when a door 16 is closed with respect to a door frame 17, as best illustrated in FIG. 5. Referring to FIGS. 4 and 5, the control device 15 is shown to comprise a metal housing 151 with a circular hole 1511 which is fitted in a cavity 171 of the door frame 17, a steel ball 152 which is received in the housing 151, a spring member 153 which is received in the housing 151 in order to urge the ball 152 to protrude partially out of the hole 1511 of the housing 151, an ON/OFF switch unit 154 which is received in the housing 151, and a pin member 155 which is disposed between the ball 152 and the switch unit 154 so that, when the door 16 is closed and the ball 152 is compressed into the housing 151 by the door 16, the pin member 155 enables the ON/OFF switch unit 154 to actuate the electromagnetic driving device 13. Therefore, the locking pin 124 will extend out of the lock body 11 into a latch hole 161 in the door 16, as shown in FIG. 5.

The conventional door lock assembly 10 suffers from the following disadvantages:

1. Because the inner tube 131 is made of a plastic material by means of an injection molding process, the outer diameter of the tube body 1311 is typically not smaller than, for example, 1.0 mm. Therefore, a space (S) for receiving the electric coil 132 between the tube body 1311 and the outer tube 134 is limited. In addition, because the electric wire 14 is connected to the end wires 1322 of the electric coil 132 in the space (S), the volume for receiving the electric coil 132 is further reduced. Since the number of turns of the electric coil 132 is limited greatly by the reduced space, the magnetic force which is generated by the electric coil 132 and which is exerted on the linkage mechanism 12 may be insufficient to push the locking pin 124 to move positively to the locked position.

2. The locking pin 124 is formed from an iron rod 1242 and a plastic tube 1241 which is sleeved around the iron rod 1242. The plastic tube 1241 is liable to wear down easily due to frequent movement of the locking pin 124.

3. Because the steel ball 152 of the control device 15 will be pushed inwardly to depress the pin member 155 and the ON/OFF switch unit 154, thereby actuating the locking pin 124 to extend out of the lock body 11 as soon as the door 16 begins to contact the door frame 17, the locking pin 124 may extend out of the lock body 11 before the lock pin 124 is aligned with the latch hole 161 of the door 16. Therefore, the locking pin 124 may be damaged due to the untimely extension thereof.

SUMMARY OF THE INVENTION

The object of the present invention is to provide a door lock assembly which can overcome the disadvantages that are commonly associated with the aforementioned conventional door lock assembly.

According to the present invention, the door lock assembly comprises:

- a lock body;
- a latching unit mounted slidably in the lock body and having a locking pin and a spring member associated with the locking pin in order to urge the locking pin to an unlocked position;
- an electromagnetic driving device including:
  - an insulating inner tube having first and second open ends;
  - an insulating outer tube having an internal wall face, a first open end and a second open end which is connected to the lock body; and
  - first and second insulating ring members connected respectively to the first and second open ends of the inner tube and received in the first and second open ends of the outer tube, each of the first and second ring members engaging fittingly the internal wall face of the outer tube so that the inner tube is concentrically fixed in the outer tube, a plug member having a disc portion which engages fittingly in the first open end of the outer tube and a cylindrical portion which extends axially from a center of the disc portion through the first ring member and into the first open end of the inner tube, a coil-receiving space being confined between the inner and outer tubes and between the first and second ring members, an electric wire having a first end connected to a power supply and a second end, and an electric coil with two end wires mounted around the inner tube within the coil-receiving space, the disc portion of the plug member having a notch formed in a periphery thereof, the first ring member having a cylindrical body, first and second annular projections formed adjacent to two ends of the cylindrical body thereof, and an annular groove formed between the first and second annular projections, the first annular projection having a notch formed in a periphery thereof, the second annular projection having an axial hole formed therethrough and an axial notch formed in a peripheral face thereof so that the end wires of the electric coil are extendible respectively into the annular groove through the axial hole and the axial notch of the second annular projection, the second end of the electric wire extending into the annular groove through the notches of the plug member and the first annular projection and being connected electrically to the end wires of the electric coil; and a linkage mechanism having a first end portion which is received in the inner tube and a second end portion which abuts a lower end of the locking pin of the latching unit so that the linkage mechanism is moved to push the locking pin to a locked position against a biasing force of the spring member when the electric coil is energized.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
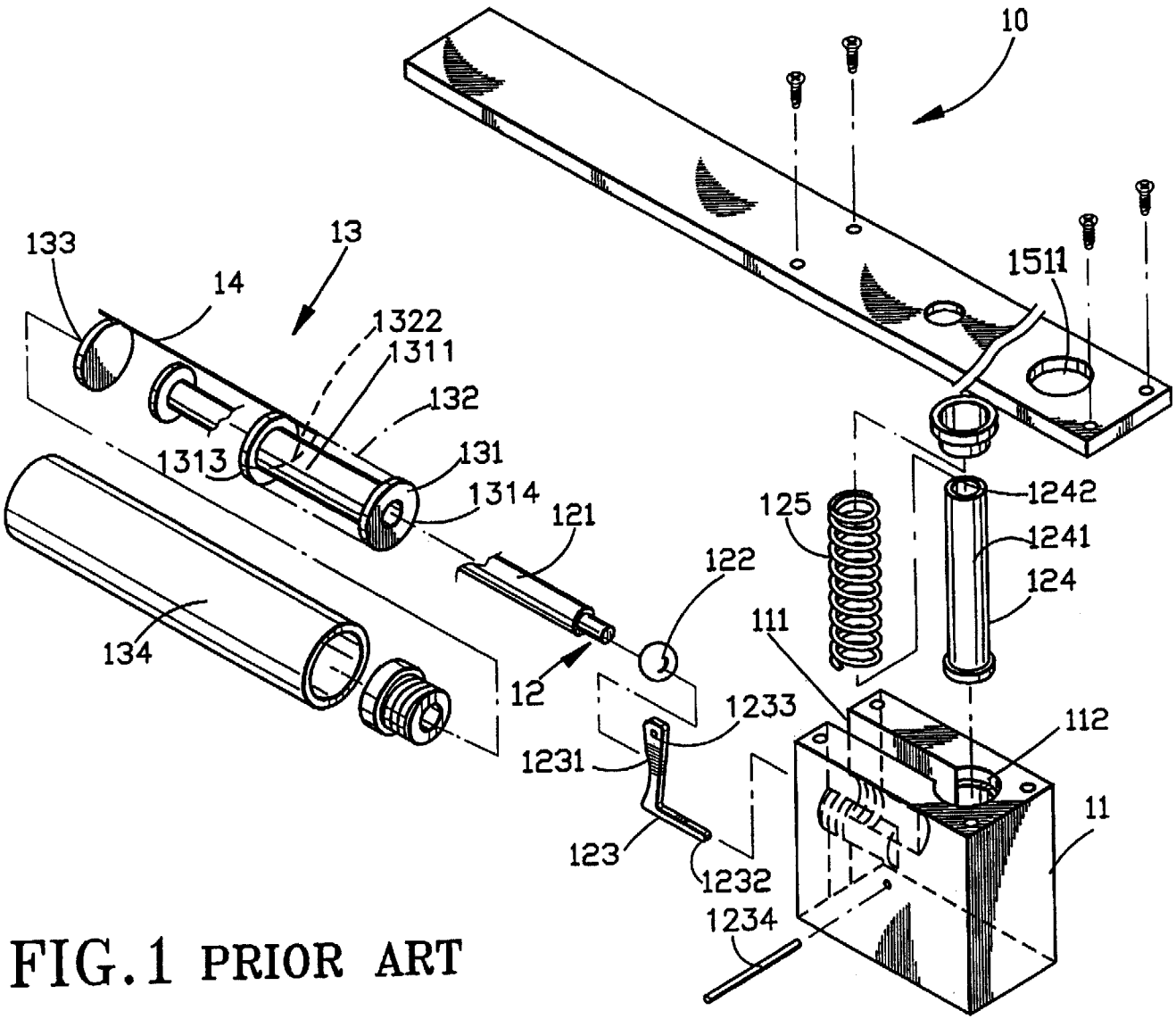
FIG. 1 PRIOR ART
FIG. 1 is an exploded view of a conventional door lock assembly.
Figure 2:
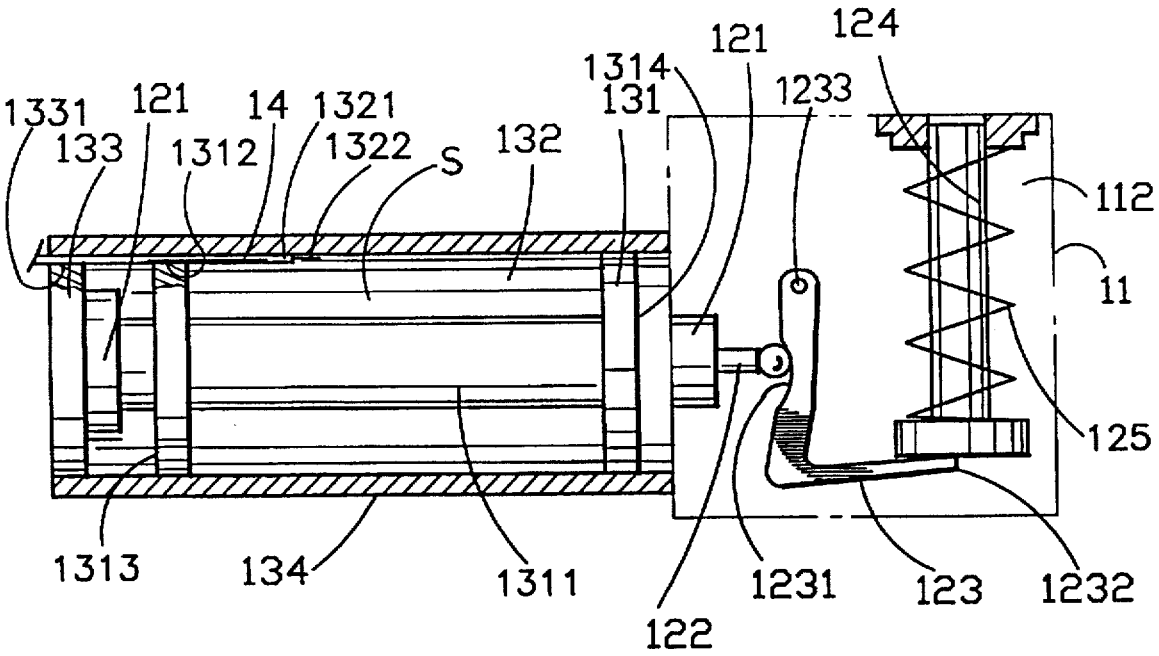
FIG.2 PRIOR ART
FIG. 2 is a sectional view of the conventional door lock assembly.
Figure 3:
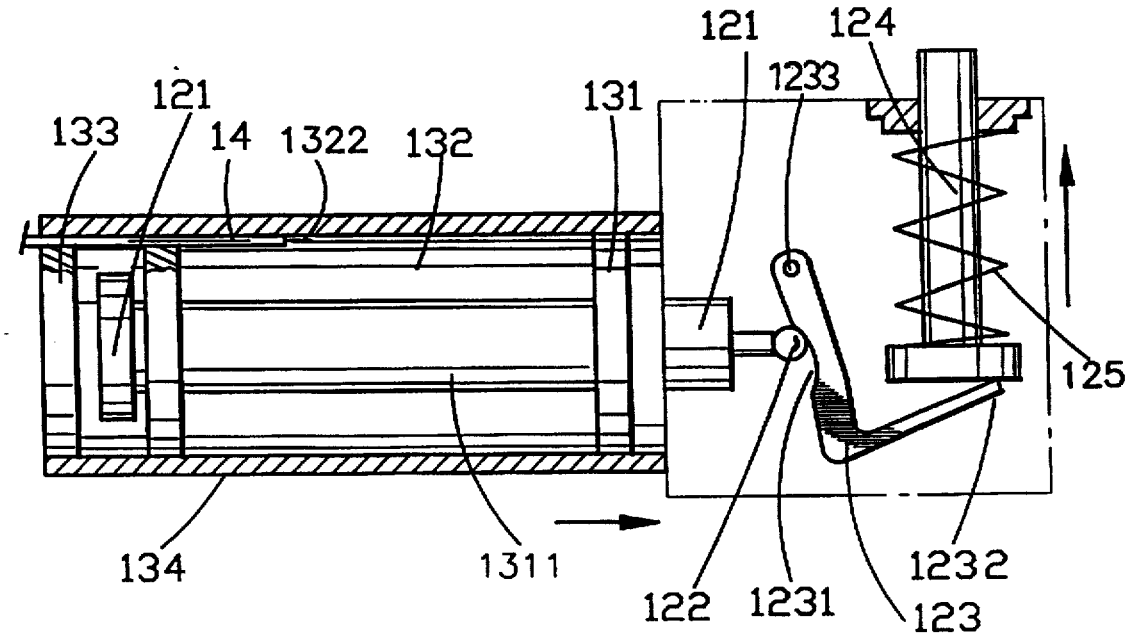
FIG.3 PRIOR ART
FIG. 3 is a sectional schematic view illustrating how a locking pin of the conventional door lock assembly is moved to a locked position.
Figure 5:
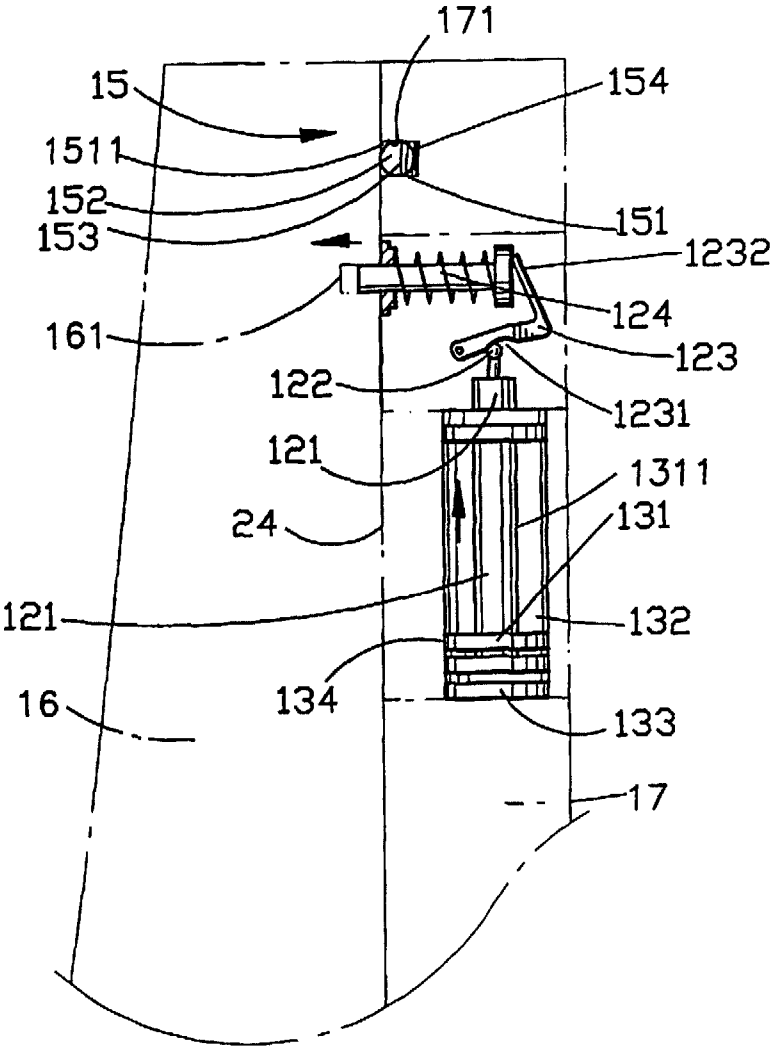
FIG.5 PRIOR ART
FIG. 5 is a schematic view illustrating how the locking pin is actuated by the control device of the conventional door lock assembly when the door and the door frame contact each other.
Figure 4:
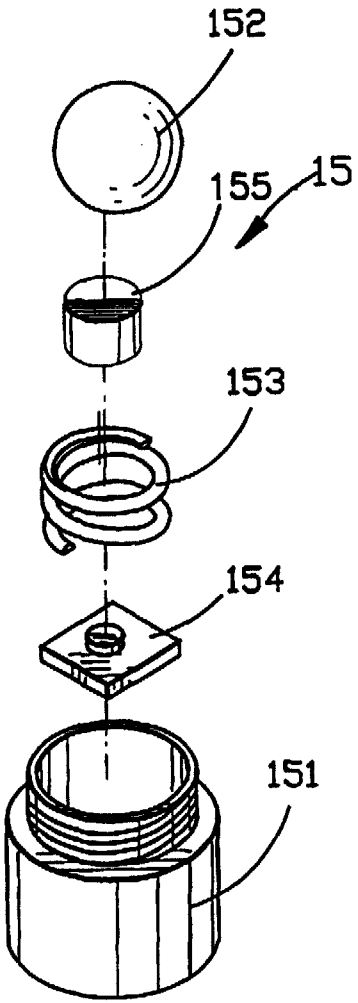
FIG.4 PRIOR ART
FIG. 4 is an exploded view of a mechanical control device of the conventional door lock assembly.
Figure 6:
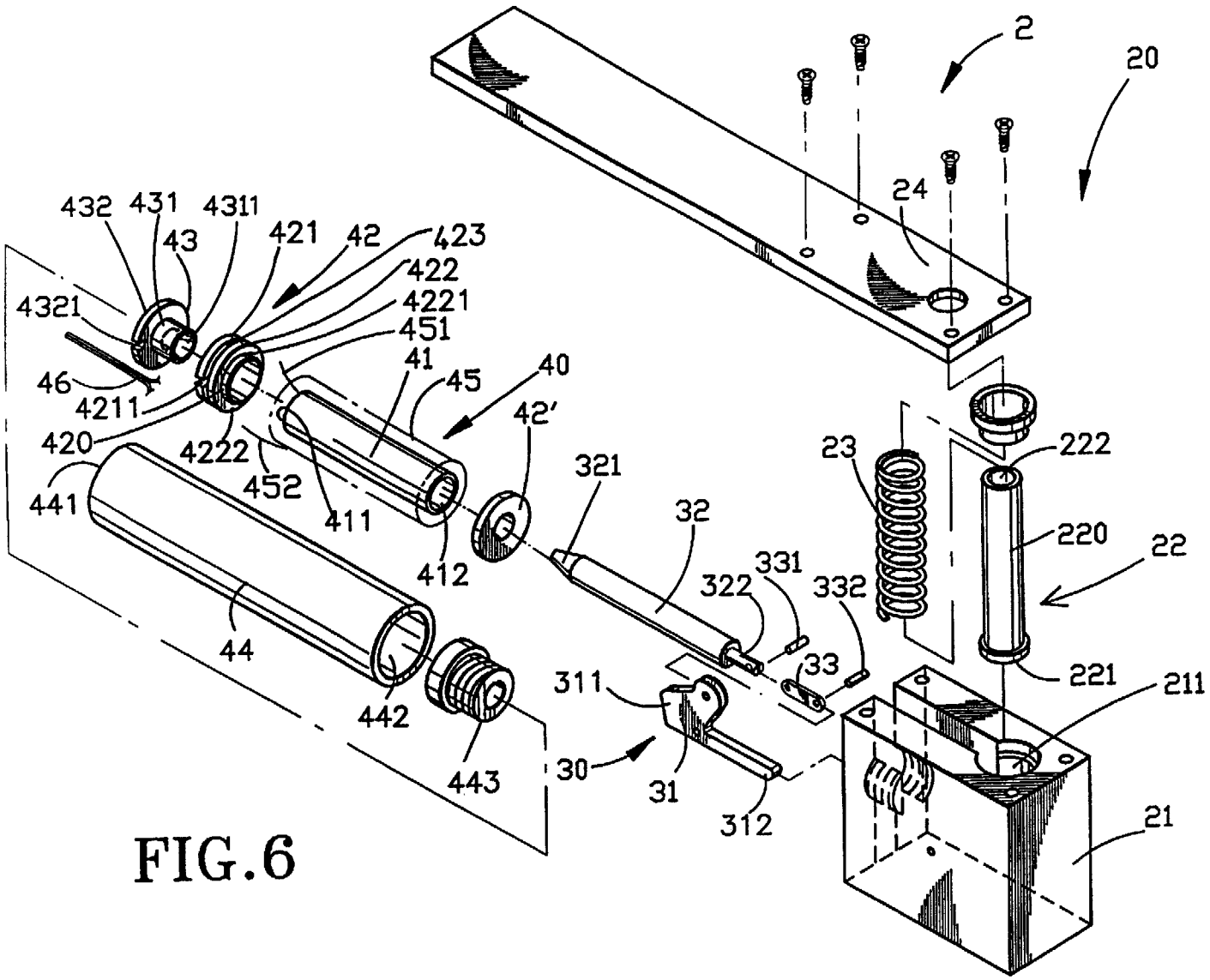
FIG. 6 is an exploded view of a preferred embodiment of a door lock assembly according to the present invention.
Figure 10:
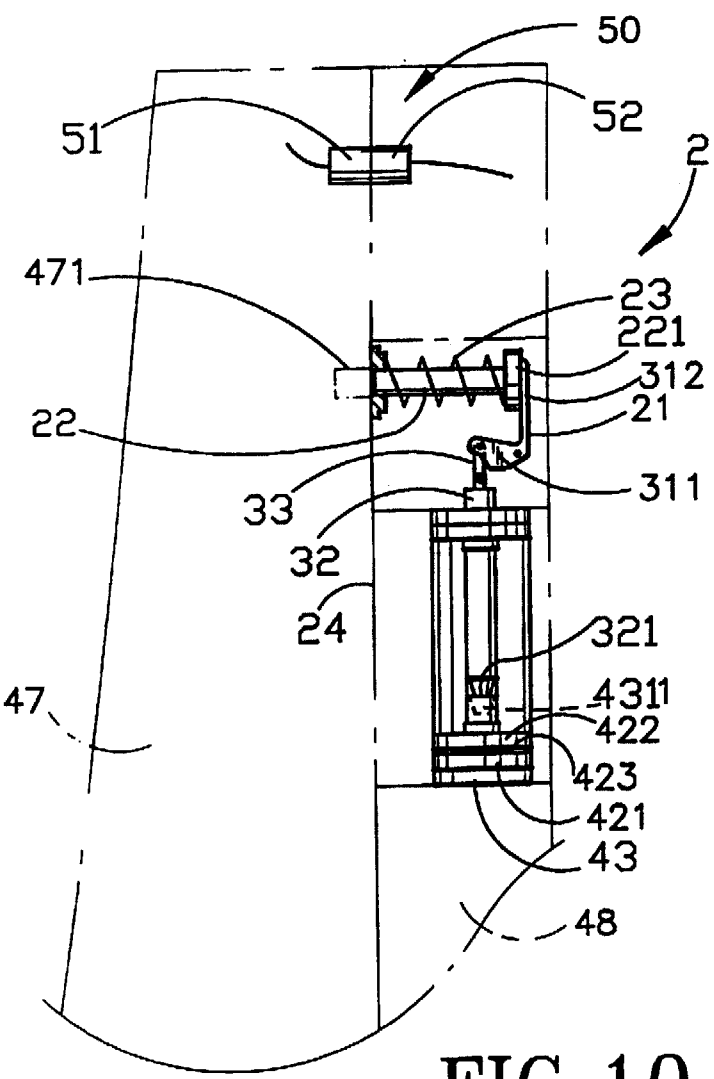
FIG. 10 is a schematic view illustrating how an electronic control device of the door lock assembly is mounted in a door and a corresponding door frame, in which the locking pin is in an unlocked position.

Referring to FIGS. 6 and 10, a preferred embodiment of a door lock assembly 2 according to the present invention is shown to comprise a lock body 20, a linkage mechanism 30, an electromagnetic driving device 40, and an electronic control device 50.

The structure of the lock body 20 is the same as that of the lock body 11 of the conventional door lock assembly 10, and will not be described in further detail hereinafter. A latching unit is constructed and mounted slidably in the lock body 20 in a manner similar to that of the conventional door lock assembly 10, except that a locking pin 22 thereof is formed from a plastic rod 222 and a metal tube 220 sleeved around the plastic rod 222 in order to protect the locking pin 22 from being damaged by friction due to the frequent movement thereof. The locking pin 22 has a spring member 23 associated therewith in order to urge the locking pin 22 to an unlocked position. A face plate 24 is connected to a side face of the lock body 21 in a known manner in order to cover a mounting hole of a door frame 48 in which the door lock assembly 2 is mounted (see FIG. 10).

Figure 7:
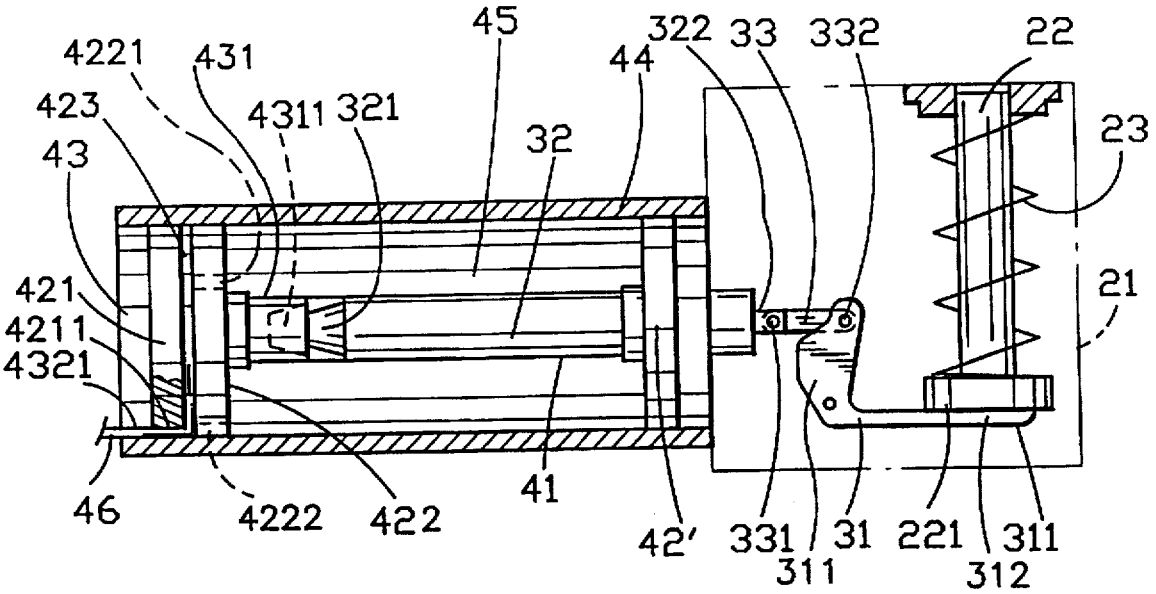
FIG. 7 is a sectional view of the preferred embodiment.

Referring to FIGS. 6 and 7, the electromagnetic driving device 40 comprises an insulating inner tube 41, an insulating outer tube 44 and first and second insulating ring members 42, 42'. The inner tube 41 is formed from a copper tube, and an insulating film wrapped around the copper tube and has first and second open ends 411, 412. Because copper has an excellent extension property, the copper tube of the inner tube 41 can be made to have a small outer diameter so that the outer diameter of the inner tube 41, for example, 0.7±0.5 mm, is smaller than that of the inner tube 131 of the conventional door lock assembly 10. Therefore, the coil-receiving space which is formed between the inner tube 41 and the outer tube 44 is larger than that of the conventional door lock assembly 10. The outer tube 44 has a first open end 441 and a second open end 442 which is connected to the lock body 21 by means of an engaging member 443 in a manner as in the prior art.

The first and second insulating ring members 42, 42' are made of a rubber material and are connected respectively to the first and second open ends 411, 412 of the inner tube 41 and are received in the first and second open ends 441, 442 of the outer tube 44. Each of the first and second ring members 42, 42' engages fittingly an internal wall face of the outer tube 44 so that the inner tube 41 is concentrically fixed in the outer tube 44. A metal plug member 43 is connected to the first ring member 42. The plug member 43 has a disc portion 432 which engages fittingly the first open end 441 of the outer tube 44, and a cylindrical portion 431 which extends axially from the center of the disc portion 432 through the first ring member 42 and into the first open end 411 of the inner tube 41. The cylindrical portion 431 of the plug member 43 has an inwardly tapered cavity 4311 formed in a distal end thereof. An annular coil-receiving space is thus confined between the inner and outer tubes 41, 44 and between the first and second ring members 42, 42'.

Figure 8:
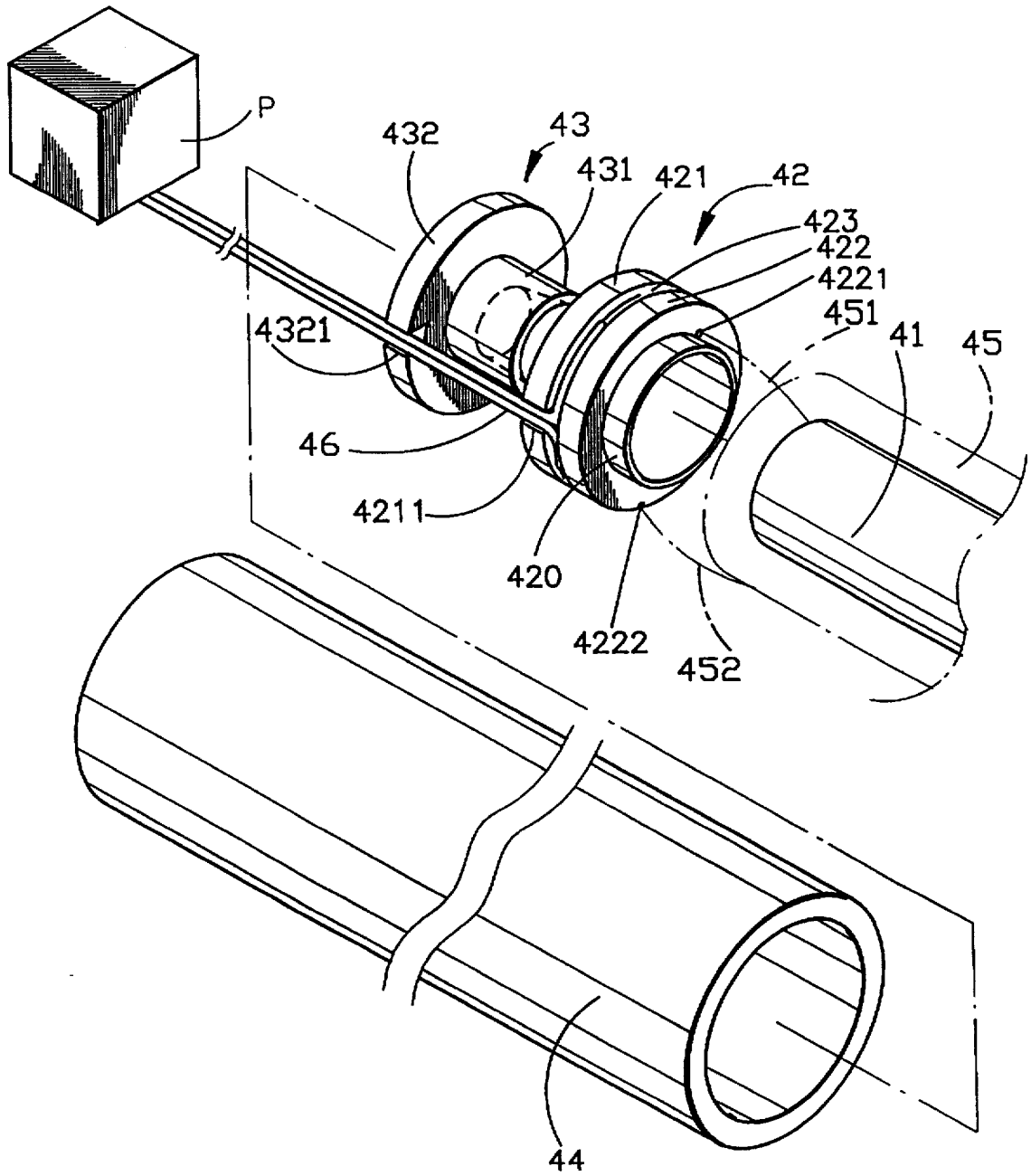
FIG. 8 is a fragmentary schematic view of an electromagnetic driving device of a locking pin of the door lock assembly according to the present invention.

Referring to FIGS. 6 and 8, an electric wire 46 is connected to a power supply (P) at a first end thereof. An electric coil 45 with two end wires 451, 452 is mounted around the inner tube 41 within the coil-receiving space. The disc portion 432 of the plug member 43 has a notch 4321 formed in a periphery thereof. The first ring member 42 has a cylindrical body 420, first and second annular projections 421, 422 formed adjacent to two ends of the cylindrical body 420 thereof, and an annular groove 423 formed between the first and second annular projections 421, 422. The first annular projection 421 has a notch 4211 formed in a periphery thereof. The second annular projection 422 has an axial hole 4221 formed therethrough and an axial notch 4222 formed in a peripheral face thereof so that the end wires 451, 452 of the electric coil 45 are extendible respectively into the annular groove 423 through the axial hole 4221 and the axial notch 4222 of the second annular projection 422. A second end of the electric wire 46 extends into the annular groove 423 through the notches 4321, 4211 of the plug member 43 and the first annular projection 421, and is connected electrically to the end wires 451, 452 of the electric coil 45.

It is noted that, because the connections of the electric wire 46 and the end wires 451, 452 are received and concealed in the annular groove 423, larger coil-receiving space is formed between the inner and outer tubes 41, 44 as compared to that of the conventional door lock assembly 10. Therefore, a greater number of turns of the electric coil 45 can be wrapped around the inner tube 41, thus resulting in a greater magnetic force which is exerted on the linkage mechanism 30 when the electric coil 45 is energized. Thereby, the locking pin 22 can be positively and reliably moved to extend out of the lock body 21 for locking purposes, which will be detailed further below.

Figure 9:
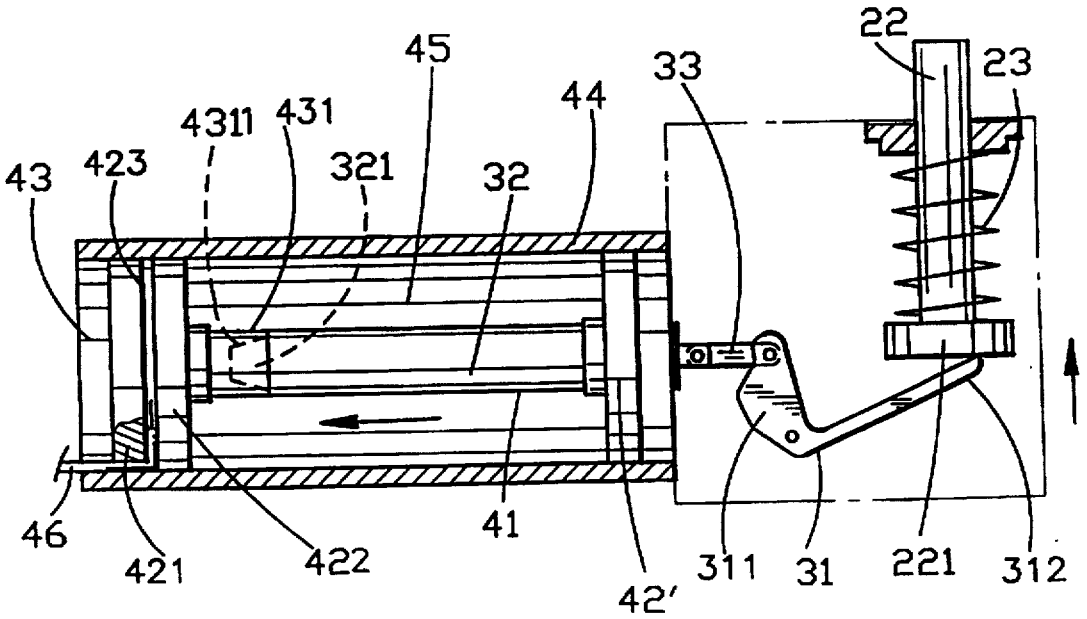
FIG. 9 is a sectional schematic view illustrating how a locking pin of the door lock assembly is moved to a locked position by the electromagnetic driving device through a linkage mechanism according to the present invention.
Figure 11:
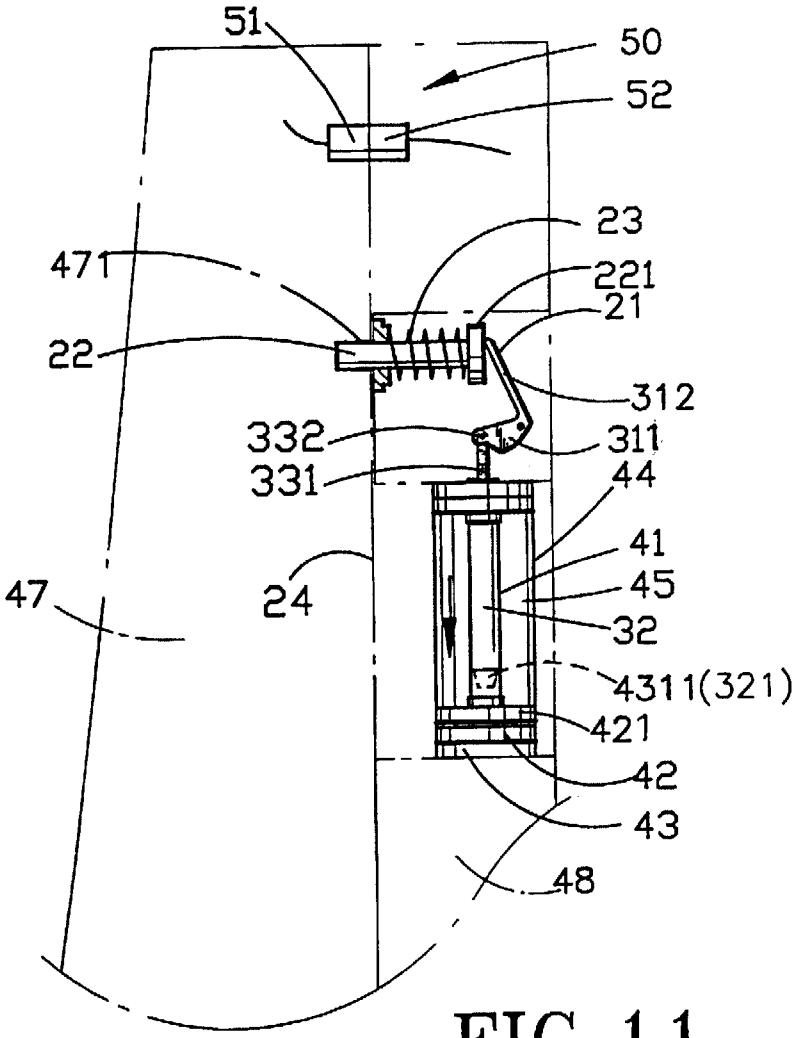
FIG. 11 is a view similar to FIG. 10, but in which the locking pin is shown in a locked position.

Referring to FIGS. 6, 7 and 10, the linkage mechanism 30 has a push rod 32 which is received slidably in the inner tube 41, an L-shaped lever 31 which is mounted pivotably in the lock body 21 at a bent portion thereof, and an elongated plate 33. The push rod 32 has a tapered first end 321 which extends into the inner tube 41 and which is engageable matingly with the tapered cavity 4311 of the plug member 43, as best illustrated in FIG. 9, and a diameter-reduced second end 322 which is connected pivotably to the elongated plate 33. The L-shaped lever 31 has a first arm 311 and a second arm 312 that abuts against a lower end 221 of the locking pin 22. Two opposite ends of the elongated plate 33 are connected respectively to the second end 322 of the push rod 32 and the first arm 311 of the L-shaped lever 31 by means of two pivot pins 331, 332. Therefore, when the electric coil 45 is energized, a magnetic force is exerted on the push rod 32 of the linkage mechanism 30 to move the push rod 32 toward the plug member 43 until the tapered first end 321 of the push rod 32 engages the tapered cavity 4311 of the plug member 43, as best illustrated in FIGS. 9 and 11. At this time, the second arm 312 of the L-shaped lever 31 is rotated to push the locking pin 22 against a biasing force of the spring member to extend out of the lock body 21 into a latch hole 471 of a door 47 in order to lock the door 47.

It is noted that since the L-shaped lever 31 is rotated about the bent portion thereof, the stroke of the locking pin 22 is greater than that of the locking pin 124 of the conventional door lock assembly 10.

Referring to FIGS. 10 and 11, the electronic control device 50 is provided for actuating the electromagnetic driving device 40 when a door is closed, as best illustrated in FIG. 10. The electronic control device 50 has a receiver 51 which is mounted in a door 47 and a transmitter 52 which is mounted to a door frame 48 and which emits a light beam. The receiver 51 and the transmitter 52 are aligned with one another when the door is closed. A signal is transmitted to a switch means (not shown) in order to permit a power supply to energize the electric coil 45, thereby moving the locking pin 22 to extend out of the lock body 21 in the manner as described hereinbefore, as best illustrated in FIG. 11. Since the switch means can only be actuated when the light emitted from the transmitter 52 is aligned with the receiver 51, the locking pin 22 may be activated to extend timely into the latch hole 471, thereby preventing damage to the locking pin 22.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A door lock assembly comprising:

a lock body;

a latching unit mounted slidably in said lock body and having a locking pin and a spring member associated with said locking pin in order to urge said locking pin to an unlocked position;

an electromagnetic driving device including:

an insulating inner tube having first and second open ends;

an insulating outer tube having an internal wall face, a first open end and a second open end which is connected to said lock body; and first and second insulating ring members connected respectively to said first and second open ends of said inner tube and received in said first and second open ends of said outer tube, each of said first and second ring members engaging fittingly said internal wall face of said outer tube so that said inner tube is concentrically fixed in said outer tube, a plug member having a disc portion which engages fittingly said first open end of said outer tube and a cylindrical portion which extends axially from a center of said disc portion through said first ring member and into said first open end of said inner tube, a coil-receiving space being confined between said inner and outer tubes and between said first and second ring members, an electric wire having a first end connected to a power supply and a second end, and an electric coil with two end wires mounted around said inner tube within said coil-receiving space, said disc portion of said plug member having a notch formed in a periphery thereof, said first ring member having a cylindrical body, first and second annular projections formed adjacent to two ends of said cylindrical body thereof, and an annular groove formed between said first and second annular projections, said first annular projection having a notch formed in a periphery thereof, said second annular projection having an axial hole formed therethrough and an axial notch formed in a peripheral face thereof so that said end wires of said electric coil are extendible respectively into said annular groove through said axial hole and said axial notch of said second annular projection, said second end of said electric wire extending into said annular groove through said notches of said plug member and said first annular projection and being connected electrically to said end wires of said electric coil; and a linkage mechanism having a first end portion which is received in said inner tube and a second end portion which abuts against a lower end of said locking pin of said latching unit so that said linkage mechanism is moved to push said locking pin to a locked position against a biasing force of said spring member when said electric coil is energized.

2. The door lock assembly as claimed in claim 1, wherein said inner tube is formed from a copper tube and an insulating film wrapped around said copper tube.

3. The door lock assembly as claimed in claim 1, wherein said cylindrical portion of said plug member has an inwardly tapered cavity formed in a distal end thereof.

4. The door lock assembly as claimed in claim 1, wherein said linkage mechanism has a push rod which is received slidably in said inner tube, an L-shaped lever which is mounted pivotably in said lock body and which has a first arm and a second arm that abuts against said lower end of said locking pin, and an elongated plate having two ends which are connected respectively to an end of said push rod and said first arm of said L-shaped lever.

5. The door lock assembly as claimed in claim 1, further comprising an electronic control device for actuating said electromagnetic driving device when a door is closed with respect to a corresponding door frame, said electronic control device having a receiver which is mounted in said door and a transmitter which is mounted to said door frame, said receiver and said transmitter being aligned with one another when said door is closed.

* * * * *